US007404352B1

(12) United States Patent
Hoffman

(10) Patent No.: US 7,404,352 B1
(45) Date of Patent: Jul. 29, 2008

(54) PERSONAL ARMOR

(75) Inventor: Vadim E. Hoffman, New York, NY (US)

(73) Assignee: Joseph Malewich, New York, NY (US)

( * ) Notice: Subject to any disclaimer, the term of this patent is extended or adjusted under 35 U.S.C. 154(b) by 0 days.

(21) Appl. No.: 11/330,876

(22) Filed: Jan. 11, 2006

(51) Int. Cl.
*F41H 5/18* (2006.01)

(52) U.S. Cl. ..... 89/36.03; 89/36.05; 2/2.5

(58) Field of Classification Search ..... 89/36.01, 89/36.03, 36.05; 2/2.5
See application file for complete search history.

(56) References Cited

U.S. PATENT DOCUMENTS 377,732 A * 2/1888 Adams ..... 2/2.5
1,649,996 A * 11/1927 Toth ..... 2/2.5
2,316,055 A * 4/1943 Davey ..... 89/36.05
4,783,853 A * 11/1988 Zuber ..... 2/456

* cited by examiner

*Primary Examiner*—Michael J. Carone
*Assistant Examiner*—Gabriel J Klein
(74) *Attorney, Agent, or Firm*—Scott H. Kaliko; McCarter & English

(57) ABSTRACT

Devices, systems and methods for shielding a person's neck and head are disclosed. The exemplary device may have an exterior portion running lengthwise approximately the length of a forearm and at least two angled surfaces widthwise for deflecting a projectile. The system may also have an interior portion adapted to fit against a forearm. The person may shield the neck and head by positioning a palm against the forehead and aligning the forearm lengthwise in front of the person's face. The exemplary system may also have a coupling portion for coupling the shield to a rifle.

6 Claims, 5 Drawing Sheets

PERSONAL ARMOR

FIELD OF THE INVENTION

The shield 100 may also have an interior portion 108. The interior portion 108 may be the underside of the plate according to the above exemplary embodiment. The interior portion 108 may rest against the sides of the user's forearm 112. When a projectile 101 hits the exterior portion 102, the energy is transferred to the user's forearm 112 over the surface area of the interior portion. The interior portion 108 may have additional padding 214 to assist in the transfer and absorption of energy. The padding 214 may also provide additional comfort to the forearm when the user is wearing the shield 100. The shield 100 may be strapped to the user's arm using one or more straps 216. The shield may also be secured to the user's forearm using a pocket within a sleeve of a jacket or shirt worn by the user. The pocket may allow the user to conceal the shield 100 so that it is not visible to others.

BACKGROUND OF THE INVENTION

Policemen enter a room and are confronted by a person. The policemen assume the person may have some type of weapon. The police bold their guns in front of themselves and aim at the person. They yell "freeze" and the person reaches into his belt or under his jacket. If the policemen hesitate, a gun could be pulled out and discharged, possibly hitting someone in the head and most likely killing him. If the policemen fire a second too soon and the person was not reaching for a weapon but rather identification or possibly a badge, an innocent life may be taken.

The bullet-proof vest has saved countless lives, but the bullet-proof vest has limitations. The bullet-proof vest does not protect against specially designed bullets such as Teflon® coated, armor piercing bullets. The bullet-proof vest does not provide protection to a user's neck, face, or head. While armor has been designed for a person since the Middle Ages to withstand the impact of swords or other lower impacts, this armor may not withstand the impact of a modern projectile.

Accordingly, an efficient and effective device, method and system is needed to deflect modern projectiles. In addition, the device, method and system may need to be inexpensive, concealable, and maneuverable.

SUMMARY OF THE INVENTION

It is, therefore, an objective of the present invention to provide devices, systems, and methods for shielding a person's neck and head. According to an exemplary embodiment of the present invention, the exemplary device and system may have an exterior portion running lengthwise approximately the length of a forearm and having at least two angled surfaces widthwise for deflecting a projectile. The system may also have an interior portion adapted to fit against a forearm. The person may shield the neck and head by positioning a palm against the forehead and aligning the forearm lengthwise in front of the person's face. The exemplary system may also have a coupling portion for coupling the shield to a rifle.

Exemplary embodiments may incorporate one or more of the following embodiments. The width of the exterior portion may be approximately the width of a person's head. In another embodiment, the device may have one or more straps for securing the device to the person's arm. In another embodiment, an aperture in the exterior portion may provide sight by the person when shielding the neck and head. In yet another embodiment, the interior portion may have padding for absorbing and dissipating energy to the forearm.

BRIEF DESCRIPTION OF THE DRAWINGS

The above and other objectives and advantages of the present invention will be apparent upon consideration of the following detailed description, taken in conjunction with the accompanying drawings, in which like reference numbers refer to like parts throughout, and in which.

DETAILED DESCRIPTION OF THE INVENTION

The invention provides a shield that allows a user to protect the head and neck region of the user. The shape of the shield absorbs the initial shock of the projectile, channels some of the energy and deflects the projectile away from the user's body. The shape of the shield does not obstruct the user's vision and may be used to deflect an attack with a sword, machete, pipe or knife. The shape of the shield dissipates the energy and shock waves away from the skin, thus minimizing pain and discomfort of the user. The deflected projectile may be a variety of objects, for example, but not limited to a bullet, armor piercing bullet, shrapnel, or other fragments.

Figure 1A:
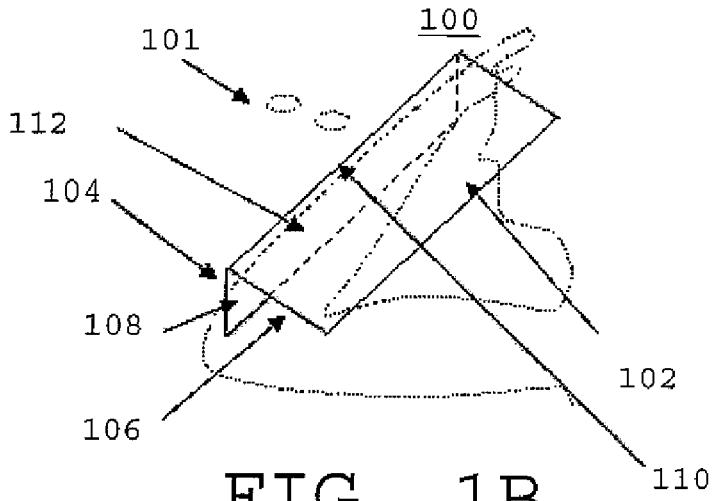
FIG. 1A is a perspective view of the armor according to a first arm-supported shield exemplary embodiment of the present invention.
Figure 1B:
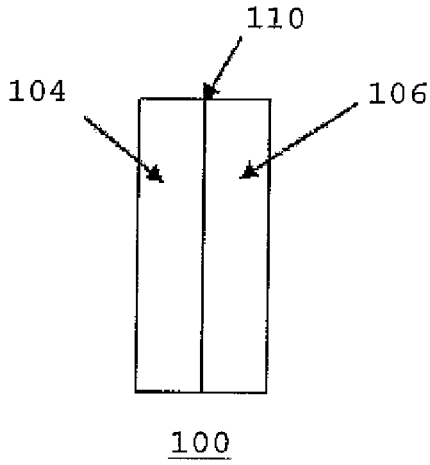
FIG. 1B is a top view of the armor according to the first arm-supported shield exemplary embodiment of the present invention.
Figure 1C:
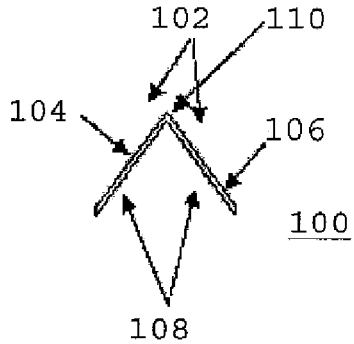
FIG. 1C is a front view of the armor according to the first arm-supported shield exemplary embodiment of the present invention.

Referring to FIGS. 1A, 1B, and 1C; the first arm-supported shield exemplary embodiment of the present invention provides a shield 100 for the user's forearm and neck and face region. The shield 100 has an exterior portion 102. The exterior portion 102 deflects the projectile away from the neck and face region of the user. The exterior portion 102 has two angled faces 104, 106. The angled surfaces allow the shield to deflect a projectile away from the user without the need to dissipate all of the projectile's momentum energy. Although only two angled faces are described according to the exemplary embodiment, the exterior portion 102 may be constructed with more than two angled surfaces.

The shield 100 may be constructed of a plate of material bent or molded along a center lengthwise axis 110 to provide the angled surfaces 106, 108. The plate may provide a "V-shaped" plate. The angle of the "V-shape" may be selected based on the intended projectile to be deflected. The plate of material may be made of a titanium plate. The titanium plate allows the shield 100 to be relatively light weight and provide protection from small arms projectiles. Although the exemplary embodiment discloses constructing the shield with a titanium plate, the shield may also be constructed using a variety of materials, for example, other metals, ceramics, or composites. The shield may also be constructed using a combination of materials. For example, the side plates 104 and 106 may be constructed of titanium plates that couple together using a composite material like Kevlar®. The Kevlar may be, for example, a sleeve portion of a vest that protects the underside of the forearm while the titanium plates protect the forearm and provide a shield for the user.

The thickness of the plate may be designed based on the intended projectile and the material used to construct the shield 100. For example, the shield 100 may be thicker for military applications, in which higher powered weapons producing projectiles with greater velocity may be confronted. In another example, the shield 100 may be designed with a thinner, lightweight material for law enforcement applications, in which the user is expected to conceal the shield 100 and wear the shield 100 for extended periods of time.

According to the exemplary embodiment, the length of the shield 100 may be approximately the length of the forearm of the user. The length may also be designed to be longer or shorter based on the intended use. For example, a longer shield may provide additional protection or a shorter shield may provide better concealment and reduced weight. The width of the shield 100 may be designed to be the width of the forearm or wider to protect the user's head and neck. The width of the shield 100 may also be short to provide better concealment. Both the width and length may be designed based on the intended use and desired attributes of the shield 100.

The shield 100 may also have an interior portion 108. The interior portion 108 may be the underside of the plate according to the above exemplary embodiment. The interior portion 108 may rest against the sides of the user's forearm. When a projectile hits the exterior portion 102, the energy is transferred to the user's forearm over the surface area of the interior portion. The interior portion 108 may have additional padding (not shown) to assist in the transfer and absorption of energy. The padding may also provide additional comfort to the forearm when the user is wearing the shield 100. The shield 100 may be strapped to the user's arm using one or more straps (not shown). The shield may also be secured to the user's forearm using a pocket within a sleeve of a jacket or shirt worn by the user. The pocket may allow the user to conceal the shield 100 so that it is not visible to others.

The user may use the shield to deflect projectiles and protect the forearm. The user may position the forearm to shield against projectiles. The user may also protect the neck and face region by placing the palm of the hand against the user's forehead and aligning the forearm in front of and parallel to the user's neck and face. When a projectile hits the exterior portion 102 of the shield 100, the projectile is deflected away from the user's body and some of the energy is transferred to the user's forearm via the interior portion 108. The energy is then transferred from the user's forearm to the user's body via the upper arm and forehead. The above is one example of how a user may brace the user's forearm to absorb the shock of a projectile. Other positions may be used with the shield 100 to safely transfer the shock of the projectile. The positions may be designed based on the intended projectile or the user's objectives.

Figure 2A:
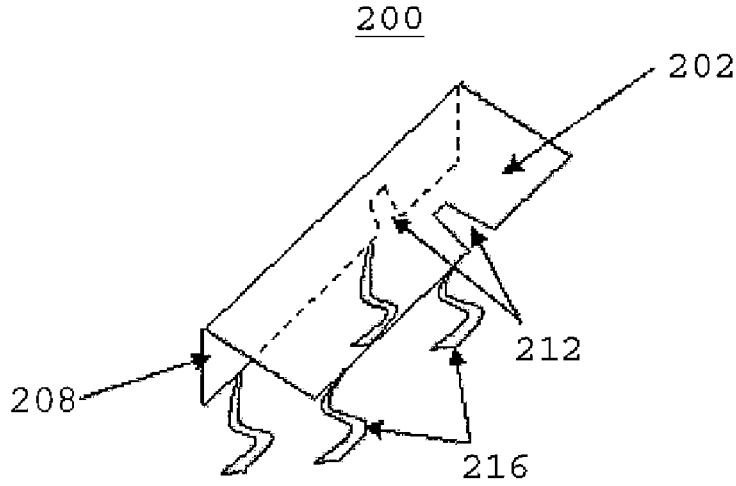
FIG. 2A is a perspective view of the armor according to a second arm-supported shield exemplary embodiment of the present invention.
Figure 2B:
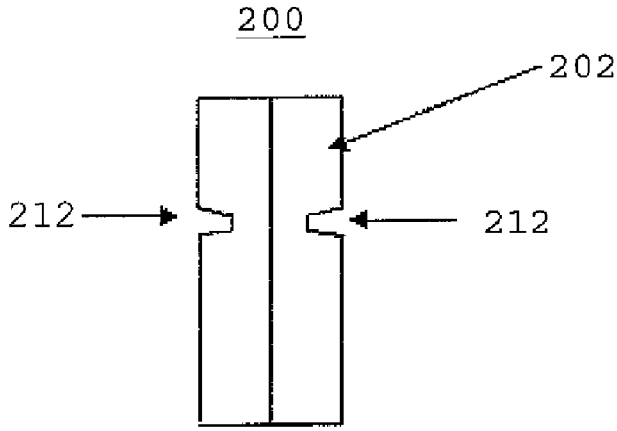
FIG. 2B is a top view of the armor according to the second arm-supported shield exemplary embodiment of the present invention.
Figure 2C:
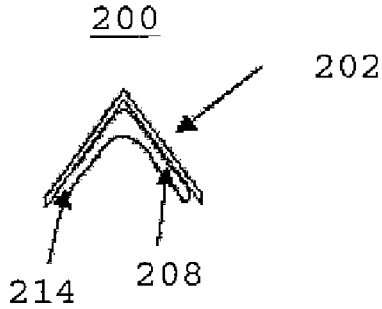
FIG. 2C is a front view of the armor according to the second arm-supported shield exemplary embodiment of the present invention.

Referring to FIGS. 2A, 2B, and 2C; the second arm-supported shield exemplary embodiment of the present invention provides a shield 200 for the user's forearm and neck and face region. The shield 200 has an exterior portion 202 and an interior portion 208. The exterior portion 202 deflects the projectile away from the neck and face region of the user. The shield 200 may also have an interior portion 208. The interior portion 208 may rest against the sides of the user's forearm and transfer some of the energy from the impact of a projectile through the user's forearm. Both the exterior portion 102 and interior portion 208 may have similar functions and designs as previously disclosed in the shield 100 of the first arm-supported shield exemplary embodiment.

In addition to aspects of the first arm-supported shield exemplary embodiment, the shield 200 may also have one or more apertures 212 that provides the user a frontal view. The apertures 212 may be designed based on the intended bracing position of the user. According to the exemplary embodiment shown in FIGS. 2A, 2B, and 2C, the apertures 212 are positioned on the edges at a location relative to the lower forearm of the user. This position allows the user to view around the user's lower forearm and provide visibility of objects located in front of the user when the user is in a bracing position. Each eye may view through the respective aperture 212 of the shield 200.

The apertures 212 are not limited to the locations disclosed in the above embodiment. The apertures 212 may be specially designed openings to prevent or reduce the likelihood of a projectile passing through the apertures 212. The apertures 212 may also be located based on the preferred bracing position of the user. The apertures 212 may also be a shock resistant, transparent material that provides the user greater visibility without increasing the risk of a projectile passing through the apertures 212.

Figure 3A:
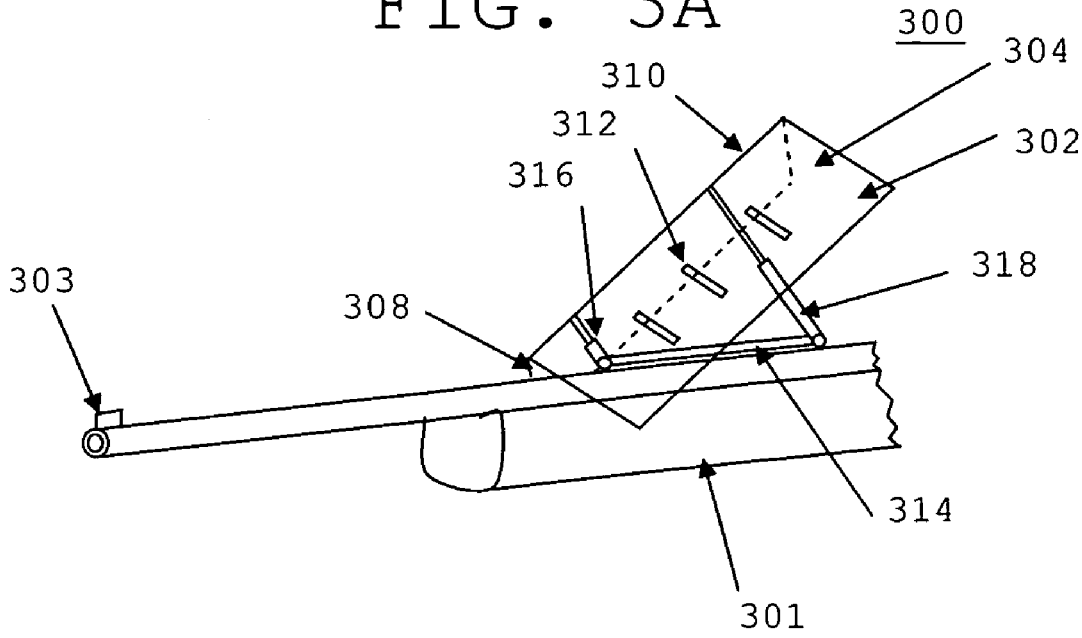
FIG. 3A is a perspective view of the armor according to a first rifle-supported shield exemplary embodiment of the present invention.
Figure 3B:
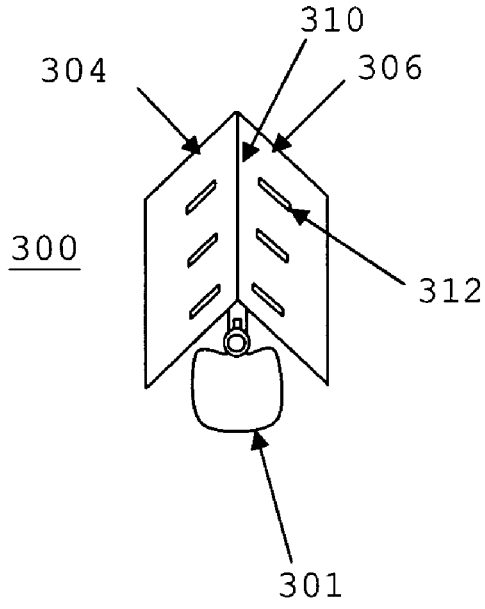
FIG. 3B is a front view of the armor according to the first rifle-supported shield exemplary embodiment of the present invention.

Referring to FIGS. 3A and 3B, the first rifle-supported shield exemplary embodiment provides a shield 300 coupled to the user's rifle 301 for protecting the user's neck and face region. The shield 300 has an exterior portion 302. The exterior portion 302 deflects the projectile away from the neck and face region of the user. The exterior portion 302 has two angled faces 304, 306. The angled surfaces allow the shield 300 to deflect a projectile away from the user without the need to dissipate all of the projectile's momentum energy. Although only two angled faces are described according to the exemplary embodiment, the exterior portion 302 may be constructed with more than two angled surfaces.

The shield 300 extends at an angle from an axis parallel to the barrel of the rifle 301. The angle of the exemplary embodiment is approximately 60 degrees; however, the angle may range from 0 to 90 degrees from the angle of the rifle. The angle may also be adjustable to the user. The shield 300 is coupled to the rifle using a coupling portion 314. The coupling portion 314 according to the first rifle-supported shield exemplary embodiment utilizes two shock absorbers 316 and 318. The first shock absorber 316 couples the front of the interior portion 308 of the shield 300 to the rifle 301. The second shock absorber 318 couples the rear of the interior portion 308 of the shield 300 to the rifle 301.

When a projectile hits the exterior portion 302 of the shield 300, the projectile is deflected away from the user's body and some of the energy is transferred to the user's rifle and body via the coupling portion 314. Some of the energy is then absorbed and transferred by the first shock absorber 316 and the second shock absorber 318. The above is one example of how the shield 300 is coupled to the rifle 301. Other exemplary coupling devices may be implemented as disclosed in additional exemplary embodiments as well as other possible designs known to an individual skilled in the art.

The shield 300 may be constructed of a plate of material bent or molded along a center lengthwise axis 310 to provide the angled surfaces 306, 308. The plate of material may be made of titanium. The titanium plate allows the shield 300 to be relatively light weight and provide protection from small arms projectiles. Although the exemplary embodiment discloses constructing the shield with a titanium plate, the shield may also be constructed using a variety of materials, for example, other metals, ceramics, or composites. The shield may also be constructed using a combination of materials. The thickness of the plate may be designed based on the intended use, projectile, and the material used to construct the shield 300.

The shield 300 may also have one or more apertures 312 that allow the user to aim the rifle while protecting the user's neck and face. The apertures 312 may be designed based on the intended shooting position of the user. According to the exemplary embodiment shown in FIGS. 3A and 3B, the apertures 312 are slits positioned at regular intervals along the length of the shield 300. These positions allow the user to view through the shield 300 and aim the rifle using the barrel's sights 303. Each eye may view through the respective aperture 312 of the shield 300. The apertures 312 allow the user to aim and fire the rifle while maintaining the position of the shield 300.

The apertures 312 are not limited to the locations disclosed in the above embodiment. The apertures 312 may be specially designed openings to prevent or reduce the likelihood of a projectile passing through the apertures 312. The apertures 312 may also be located based on the preferred bracing position of the user. The apertures 312 may also be a shock resistant, transparent material that provides the user greater visibility without increasing the risk of a projectile passing through the apertures 312.

Figure 4A:
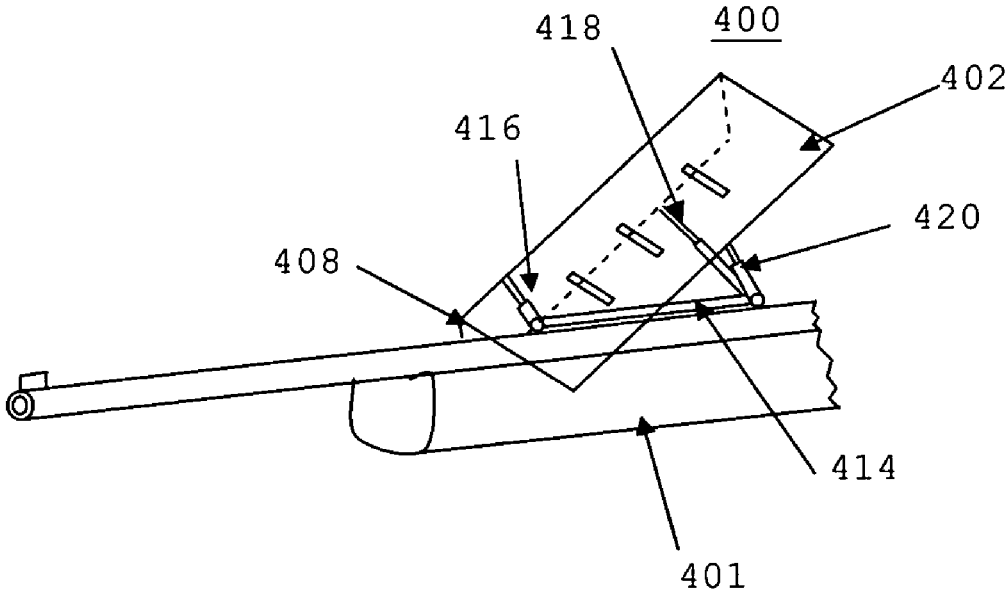
FIG. 4A is a perspective view of the armor according to a second rifle-supported shield exemplary embodiment of the present invention.
Figure 4B:
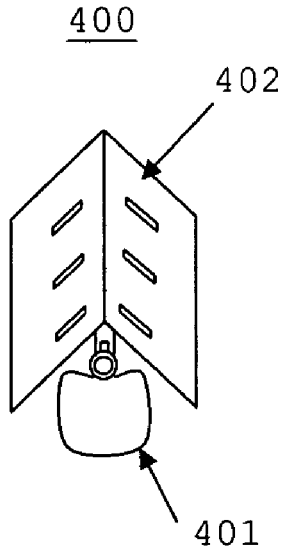
FIG. 4B is a front view of the armor according to the second rifle-supported shield exemplary embodiment of the present invention.

Referring to FIGS. 4A and 4B, the second rifle-supported shield exemplary embodiment provides a shield 400 coupled to the user's rifle 401 for protecting the user's neck and face region. The shield 400 has an exterior portion 402 and other shield components similar to those disclosed in the first rifle-supported shield exemplary embodiment. The shield 400 is coupled to the rifle using a coupling portion 414.

The coupling portion 414 according to the second rifle-supported shield exemplary embodiment utilizes three shock absorbers 416, 418, and 420. The first shock absorber 416 couples the front of the interior portion 408 of the shield 400 to the rifle 401. The second shock absorber 418 and third shock absorber 420 couple the rear of the interior portion 408 of the shield 400 to the rifle 401. The second shock absorber 418 and third shock absorber 420 provide additional lateral support. When a projectile hits the exterior portion 402 of the shield 400 at a side angle to the barrel of the rifle 401 barrel, the second shock absorber 418 and third shock absorber 420 provide additional absorption and transfer to the user's rifle and body.

Figure 5A:
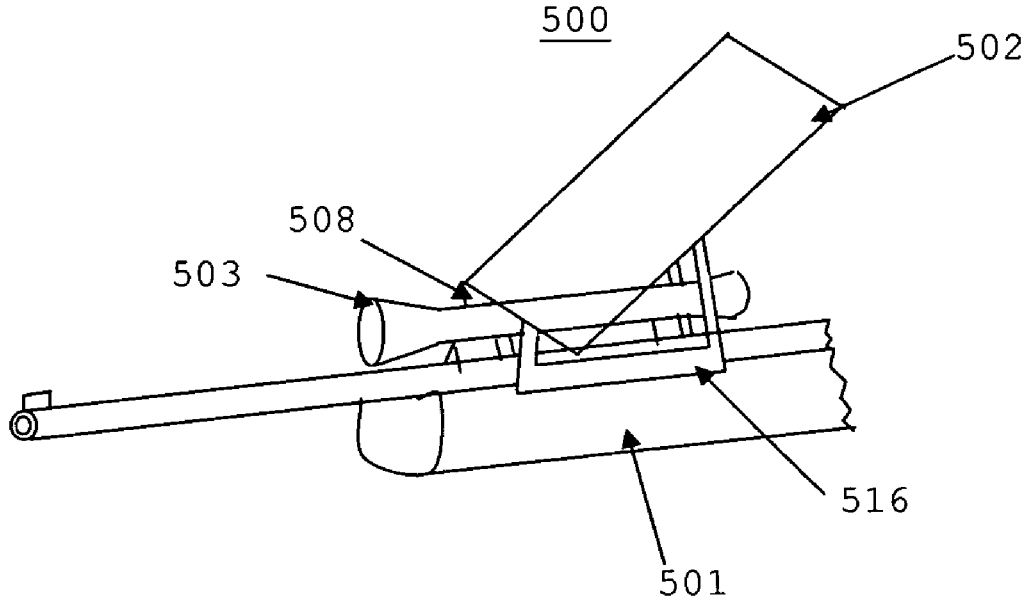
FIG. 5A is a perspective view of the armor according to a third rifle-supported shield exemplary embodiment of the present invention.
Figure 5B:
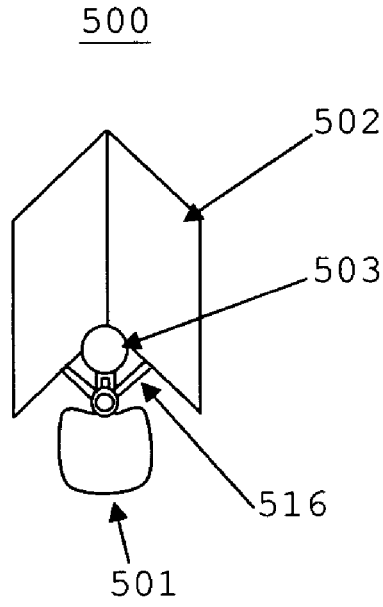
FIG. 5B is a front view of the armor according to the third rifle-supported shield exemplary embodiment of the present invention.

Referring to FIGS. 5A and 5B, the third rifle-supported shield exemplary embodiment provides a shield 500 coupled to the user's rifle 501 for protecting the user's neck and face region. The shield 500 has an exterior portion 502 and other shield components similar to those disclosed in the first rifle-supported shield exemplary embodiment. The shield 500 is coupled to the rifle using a coupling portion 514.

The coupling portion according to the third rifle-supported shield exemplary embodiment utilizes a shield support 516. The shield support 516 couples the front and back of the interior portion 508 of the shield 500 to a rifle 501. The shield support 516 may be designed to allow a scope 503 of the rifle 501 to be positioned between the rifle 501 and the vertex of the "V-shaped" shield 500. This may allow the user to aim the rifle 501 using the scope 503 while still being protected by the shield 500.

The shield support 516 according to the third embodiment may be a rigid or semi-rigid coupling device. The shield support 516 may be permanently coupled or removably coupled to the rifle 501. The shield support 516 may be coupled to the rifle 501 using a variety of fasteners and may be designed to fit a variety of rifles. This interchangeable design may allow the user to couple the shield 500 to other rifles, thus reducing the need for multiple shields. The shield support 516 may also have a combination of rigid supports and shock absorbing supports.

It will be understood that the foregoing is only illustrative of the principles of the invention and that various modifications can be made by those skilled in the art without departing from the scope and spirit of the invention. Accordingly, such embodiments will be recognized as within the scope of the present invention. Various aspects disclosed in the exemplary embodiments may be incorporated with aspects disclosed in other exemplary embodiments without departing from the scope of the invention.

Persons skilled in the art will also appreciate that the present invention can be practiced by other than the described embodiments, which are presented for purposes of illustration rather than of limitation and that the present invention is limited only by the claims that follow.

What is claimed is:

1. A method for shielding a neck and head of a user comprising the following actions:

positioning an exterior portion of a shield running lengthwise, approximately the length of a forearm for deflecting a projectile and at least two angled surfaces of an interior portion against the sides of the forearm; and positioning a palm of the user against the forehead of the user and aligning the forearm lengthwise in front of the user's face.

2. The method of claim 1, further comprising the action of:

deflecting a projectile with at least two angled surfaces of the exterior portion.

3. The method of claim 1, further comprising the action of:

coupling one or more straps around the arm of the user.

4. The method of claim 1, wherein the projectile is a bullet.

5. The method of claim 1, further comprising the action of:

viewing through at least one aperture in the exterior portion of the shield.

6. The method of claim 1, further comprising the action of:

deflecting a projectile with at least two angled surfaces of the exterior portion and absorbing and dissipating projectile momentum with padding located between the interior portion and the forearm of the user.

* * * * *

UNITED STATES PATENT AND TRADEMARK OFFICE

CERTIFICATE OF CORRECTION

PATENT NO. : 7,404,352 B1
APPLICATION NO. : 11/330876
DATED : July 29, 2008
INVENTOR(S) : Vadim E. Hoffman It is certified that error appears in the above-identified patent and that said Letters Patent is hereby corrected as shown below:

Column 1, line 25, delete “bold” and insert --hold--

Signed and Sealed this

Fourteenth Day of April, 2009

JOHN DOLL
*Acting Director of the United States Patent and Trademark Office*